US005433332A

United States Patent [19]

Busisi

[11] Patent Number: 5,433,332

[45] Date of Patent: Jul. 18, 1995

[54] CONTAINER FOR ROVING

[75] Inventor: Iginia Busisi, Milan, Italy

[73] Assignee: Sira S.p.A.

[21] Appl. No.: 192,196

[22] Filed: Feb. 4, 1994

Related U.S. Application Data

[63] Continuation of Ser. No. 866,314, Apr. 9, 1992, abandoned.

[30] Foreign Application Priority Data

Apr. 12, 1991 [IT] Italy ..... MI91A1021

[51] Int. Cl.[6] ..... B65H 75/16

[52] U.S. Cl. ..... 220/4.33; 220/648; 19/159 R

[58] Field of Search ..... 220/4.33, 648; 19/159 R

[56] References Cited

U.S. PATENT DOCUMENTS

| | | | |
|---|---|---|---|
| D. 258,409 | 3/1981 | Nattrass | 220/4.33 |
| 849,551 | 4/1907 | Lutterman | 220/559 |
| 1,047,653 | 12/1912 | Killion | 220/4.33 |
| 1,135,282 | 4/1915 | Hernandez | 220/559 |
| 1,224,234 | 5/1917 | Taber | 220/4.33 |
| 1,252,204 | 1/1918 | Valeri | 220/4.33 |
| 1,441,509 | 1/1923 | Killion | 220/4.33 |
| 2,159,262 | 5/1939 | Feiss | 220/559 |
| 2,229,811 | 1/1941 | Lockhart | 220/648 |
| 2,344,856 | 3/1944 | Earle | 220/648 |
| 2,920,682 | 1/1960 | Lindberg | 220/4.24 |
| 3,291,134 | 12/1966 | Novales | 220/559 |
| 3,570,801 | 3/1971 | Moritz | 220/4.33 |
| 3,572,535 | 3/1971 | Kinzie | 220/4.33 |
| 3,760,970 | 9/1973 | Lutz | 220/4.33 |
| 3,966,285 | 6/1976 | Porch et al. | 220/4.33 |
| 3,991,264 | 11/1976 | Connell | 220/4.24 |
| 4,261,079 | 4/1981 | Masini et al. . | |
| 4,593,813 | 6/1986 | Powel | 220/4.24 |
| 5,069,354 | 12/1991 | Tannenbaum | 220/4.24 |

FOREIGN PATENT DOCUMENTS 0344484 6/1989 European Pat. Off. .

OTHER PUBLICATIONS

"Dew Co. Hi-Tech Plastic Roving Cans, Springs and Lids", Oct. 28, 1992.

*Primary Examiner*—Joseph Man-Fu Moy
*Attorney, Agent, or Firm*—Lerner, David, Littenberg, Krumholz & Mentlik

[57] ABSTRACT

In a container, or vessel for roving, comprising a fixed bottom, a movable bottom parallel to said fixed bottom and a side wall perpendicular to said bottoms, said wall is constituted by at least two distinct elements, fastenable to one another and/or to said fixed bottom.

9 Claims, 2 Drawing Sheets

6
4
4'
8
11
3
6
8
6
8
8
6
1
4''
9
2
10
8
6

12
13
13
13

Fig. 2
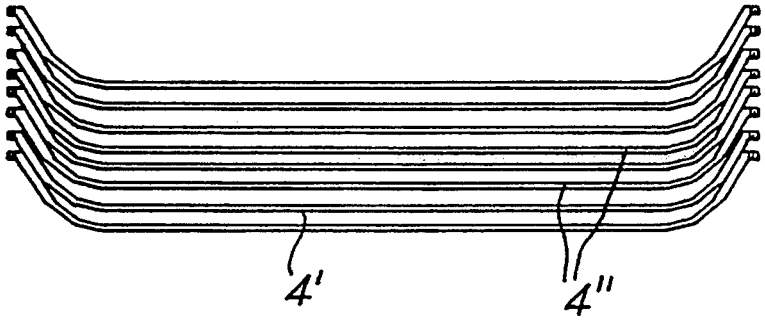
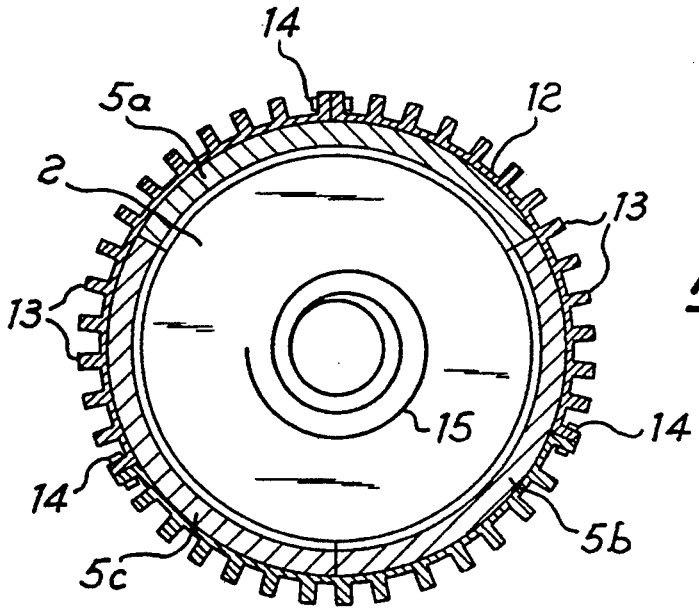
Fig. 4
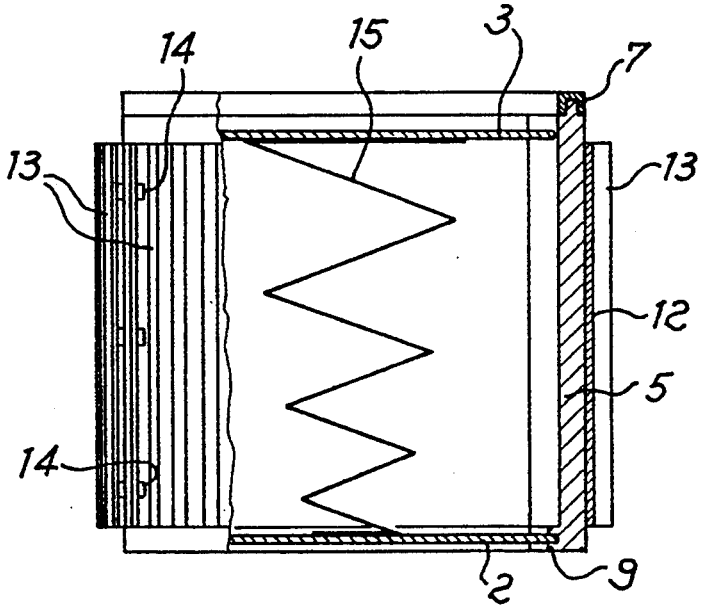
Fig. 5

CONTAINER FOR ROVING

This is a continuation of application Ser. No. 07/866,314 filed Apr. 9, 1992 now abandoned.

BACKGROUND OF THE INVENTION

FIELD OF THE INVENTION

The present invention concerns a container for rovings of textile fibers.

As it is known, the carriage of the roving from a drawing frame, where it is pre-drawn, to a spinning machine is performed either by means of reels on which the roving is wound up, or by means of containers known also as "vessels", inside which the pre-drawn roving is accomodated in subsequent turns.

Essentially said vessels are constituted by side walls having circular section or elongated shape, by a fixed bottom substantially perpendicular to said walls and by a movable bottom, positioned on top of said fixed bottom and parallel thereto. The movable bottom is pushed upwards by the action of elastic elements that, following the progressive deposition of the roving on the movable bottom, are gradually compressed leading the movable bottom from an upper position adjacent to the upper end of the vessel to a lower position adjacent to the fixed bottom.

Given the volume occupied by the wound up roving, in order to be able to carry a sufficient amount, the vessels must have considerable size. This requirement involves some drawbacks.

First of all the known vessels occupy large spaces during their carriage and storage with the ensuing technical problems.

Furthermore, their manufacture, mainly if performed by molding in plastic material, requires molds of large dimensions, namely with very high costs.

OBJECTS OF THE INVENTION

Object of the present invention is to solve the aforesaid problems and to obtain vessels for roving of textile fibers, obtainable in an easy and economic way and capable of being carried and/or stored in relatively reduced spaces.

SUMMARY OF THE INVENTION

Said object is achieved by means of the present invention that concerns a container, or vessel, for roving, of the type comprising a fixed bottom, a movable bottom parallel to said fixed bottom and a side wall perpendicular to said bottoms, characterized in that said wall is constituted by at least two distinct elements fastenable to each other and to said fixed bottom.

According to a preferential feature of the invention, the walls of vessels having elongated section consist of two identical elements specularly opposite to each other and fastened to each other by means of bolts screwed onto corresponding threaded projections, adjacent and cooperating with each other.

Similarly, the walls of vessels with circular section are preferably constituted by at least three identical elements for better superimposition during storage.

According to a further feature of the invention also the fixed bottom and the movable bottom are exactly alike and the fixed bottom is accomodated in a groove provided in a thickening of the lower portion of the elements constituting the vessel walls.

The advantages obtainable thanks to the present invention are evident: it allows to considerably simplify the manufacture of vessels by producing a plurality of identical elements, with molds of reduced dimensions and considerably simplified impressions, and therefore with reduced costs.

The invention will be now described more in detail with reference to the accompanying drawings given with illustrative and not limiting purposes, where:

BRIEF DESCRIPTION OF THE DRAWINGS

FIG. 2 is a side view of a plurality of piled up elements of wall;

FIG. 4 is the top view of another embodiment of the invention;

FIG. 5 is a side view, partially in section, of the embodiment of FIG. 4.

DESCRIPTION OF THE PREFERRED EMBODIMENTS

As previously mentioned, the container 1 according to the invention is of the type comprising (FIG. 1) a fixed bottom 2, a movable bottom 3 placed on top and parallel to the fixed bottom 2, and a side wall 4.

Figure 1:
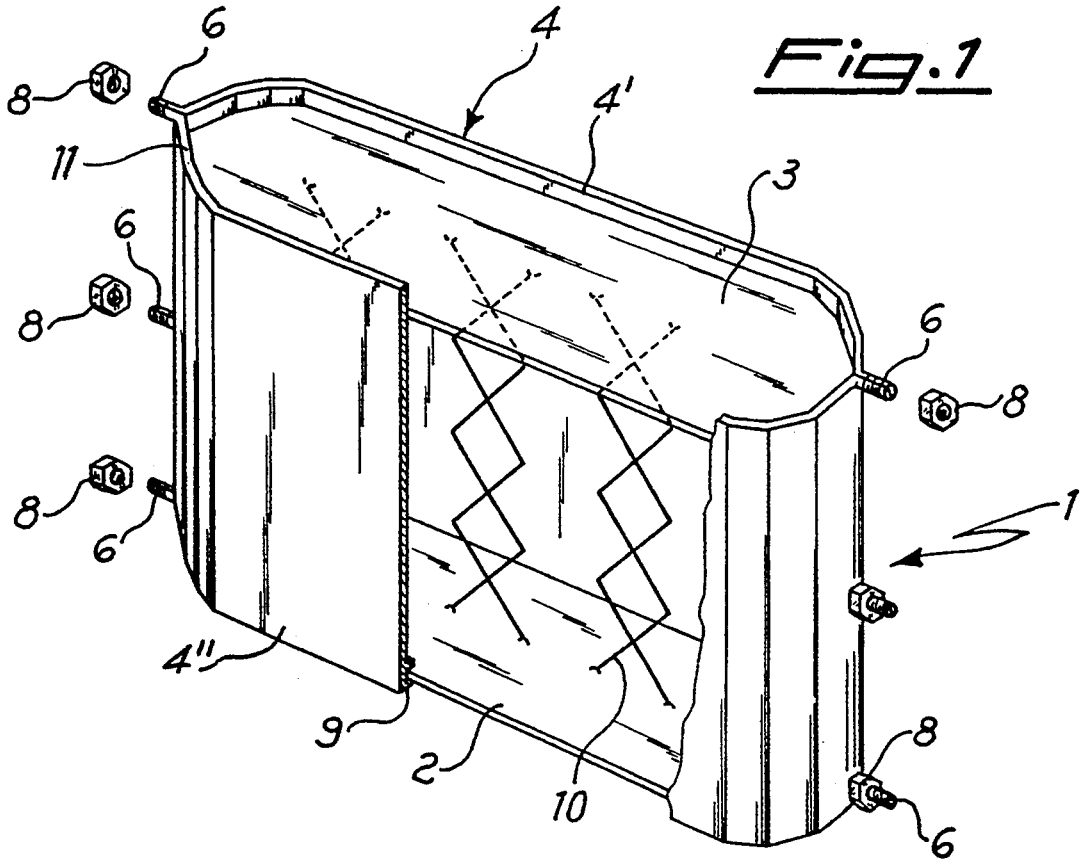
FIG. 1 is a perspective view, partially in section, of an embodiment of the invention.

The wall 4 is provided with one or more sides, that means that it may have polygonal section, circular section (as shown in FIG. 4) or an elongated shape (FIG. 1). Generally the preferred embodiments are those with circular or elongated section.

In any case, the invention foresees that the vessel wall be constituted by at least two distinct elements fastenable to each other and/or to said fixed bottom. The embodiment of FIGS. 1 and 2 shows a container of the type with elongated shape section, wherein the wall 4 is constituted by two elements 4', 4'', exactly alike and positioned specularly opposite and fastenable to one another. As visible in FIG. 1, preferential means to reciprocally fasten two elements 4' and 4'' consist of a plurality of projections 6 coupled along the vertical edges 11 of the elements 4' and 4'', in a way to be adjacent and cooperate with each other when the elements 4' and 4'' are arranged specularly and opposite. Preferably the projections 6 are semicylindrical and partly threaded: when the projections of an element are matched with the partially threaded projections of the other element, cylindrical threaded projections are obtained on which bolts 8 can be screwed on allowing reciprocal fastening of the elements 4' and 4'', thus forming the vessel wall 4.

It is here pointed out that of course other means can be possibly used to reciprocally fasten the elements 4' and 4'' opposite to each other.

The elongated shaped section of the vessel is approximately lenticular, so as to allow an optimal superimposition of the elements 4', 4'', as visible in FIG. 2.

In case of containers with circular section (FIGS. 4 and 5), the invention foresees that the wall 5 be constituted by at least three distinct elements each one presenting an angle of less than 180 degrees. Preferably, but not necessarily, the wall of the container with circular section, 5, is contistuted by three elements 5*a*, 5*b*, 5*c*, exactly alike to each other.

In order to fasten in position said elements, the invention foresees the presence of one or more reinforcing rings 7 positioned at least in correspondence to the upper edge of the wall 5 (FIG. 5). The reinforcing ring 7 can be only external or, as shown in FIG. 5, it can also include a portion internal to the wall 5.

Both in the container of FIG. 1 and in that of FIG. 5, the fixed bottom is accomodated in a groove provided in a thickening 9 present on the internal face of the container wall. More particularly, the bottom of the groove rests on the same plane of the internal face of the container wall, in a way that it is possible to use one single type of bottom to be adopted both as fixed bottom 2 and as movable bottom 3, with the obvious advantages of production.

Furthermore, the restrained joint positioning of the movable bottom presents further advantages. In fact, as previously mentioned, the bottom 3 is movable from the upper opening of the vessel as far as in the vicinity of the fixed bottom 2, under the action of the weight of the roving as it is deposited thereon, with the contrast of at least a spring 15 or similar elastic element controlling the downward movement.

Most of all in the case of vessels with elongated wall (FIG. 1), pantograph supports 10 are preferably adopted for a better control of the down run of the bottom 3.

Evident is the advantage given by the modular construction of the container wall: in fact it is possible to manufacture separately the group constituted by bottom 2, bottom 3, spring and/or pantographs and insert it between the elements that form the wall 4 or 5 at the moment of its realization.

Figure 3:
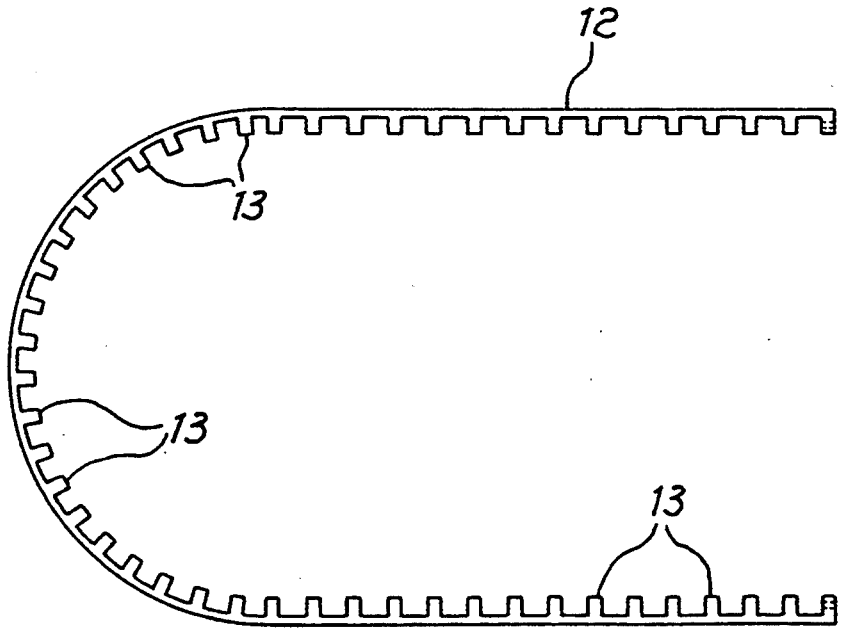
FIG. 3 is a cross sectional view of a second embodiment according to the invention.

According to a further feature of the invention, the wall thus obtained is stiffened, mainly in case of circular vessel, by means of a reinforing band (FIGS. 3–5). Said band is preferably constituted by at least a flexible element 12 provided with vertical ribs 13. The ribs placed at the ends of the element 12 are provided with holes or similar seats for nut and bolt means 14, or the like, to be fastened to each other or to similar ribs of further elements 12.

FIG. 4 exemplifies a reinforcing band consisting of three different stiffening elements 12. As it can be noticed, the ribs 13 are preferably positioned on the outside, so as to facilitate both the band assembling and the rotation of the vessel performed by the vessel turning systems provided on the drawing frame and the spinning machines.

In this case, too, the invention foresees a standardization of the elements to be obtained, preferably by injection molding of appropriate plastic materials.

As a further feature (not shown) the side walls, when assembled, show one or more vertical grooves opened towards the spring(s) acting on the movable bottom. The or each spring and/or the movable false bottom has one or more protruding elements so shaped to be housed and vertically movable within the groove in order to avoid any spring deflection during compression.

The groove(s) and protruding element(s) can be for instance T-shaped in section.

Preferably, the elements 12 will have lengths equivalent to integral multiples of $\pi$, preferably $\pi 10^n$, and the vessels will have diameter corresponding to m $10^n$, where n and m are whole numbers different and equal to each other. In this way the stiffening band can be obtained by fastening to each other m elements 12.

For instance, being m=5 and n=2, measuring in millimeters, we will have elements 12 314 mm long and vessel with diameter of 500 mm and circumference of $500 \times 3.14$. The number of elements 12 necessary to obtain the reinforcing and stiffening band is therefore $(500 \times 3.14):314=5$.

I claim:

1. A container comprising:

first and second identical wall elements, each of said first and second identical wall elements having a generally planar elongate side and a generally arcuate short side, said identical elements being secured together at said corresponding arcuate short side to form a continuous wall, said continuous wall defining an inner perimeter and having an upper end and a lower end spaced along a vertical axis;

a fixed bottom panel extending between said first and second identical wall elements and being secured therebetween adjacent to said lower end;

movable bottom panel means for movably supporting roving thereon, said movable bottom panel means being adapted for slidable movement between said fixed bottom panel along said vertical axis between said upper and lower ends within said inner perimeter of said continuous wall; and fastening means for removably securing said plurality of wall elements together, said fastening means including a plurality of at least partially threaded projections and a plurality of corresponding nuts adapted to be threadably mounted thereon.

2. A container comprising:

a plurality of wall elements connected to form a continuous wall, said continuous wall defining an inner perimeter and having an upper end and a lower end spaced along a vertical axis;

a fixed bottom panel extending between said plurality of wall elements and being secured therebetween adjacent said lower end;

movable bottom panel means for movably supporting roving thereon, said movable bottom panel means being adapted for slidable movement above said fixed bottom panel along said vertical axis between said upper and lower ends within said inner perimeter of said continuous wall; and at least one stiffening band, said continuous wall having an internal side and an external side, said at least one stiffening band including a plurality of ribs extending parallel to said vertical axis and being arranged on said external side of said continuous wall to provide reinforcement thereto.

3. The container of claim 2, wherein said at least one stiffening band includes a plurality of flexible elements.

4. The container of claim 2, wherein said at least one stiffening band is connected to said continuous wall at said upper end thereof to provide reinforcement thereto.

5. The container of claim 2, further comprising fastening means for removably securing said plurality of wall elements together.

6. The container of claim 5, wherein said fastening means comprises a plurality of at least partially threaded projections and a plurality of corresponding nuts adapted to be threadably mounted thereon.

7. A container comprising:

first and second identical wall elements, each of said first and second identical wall elements having a generally planar elongate side and a generally arcuate short side, said identical elements being secured together at said corresponding arcuate short side to form a continuous wall, said continuous wall defining an inner perimeter and having an upper end and a lower end spaced along a vertical axis;

a fixed bottom panel extending between said first and second identical wall elements and being secured therebetween adjacent to said lower end;

movable bottom panel means for moveably supporting roving thereon, said movable bottom panel means being adapted for slidable movement between said fixed bottom panel along said vertical axis between said upper and lower ends within said inner perimeter of said continuous wall;

fastening means for removably securing said plurality of wall elements together, said fastening means including a plurality of at least partially threaded projections and a plurality of corresponding nuts adapted to be threadably mounted thereon; and at least one stiffening band, said continuous wall having an internal side and an external side, said at least one stiffening band arranged on said external side of said continuous wall to provide reinforcement thereto.

8. The container of claim 7 wherein said at least one stiffening band includes a plurality of flexible elements.

9. The container of claim 8, wherein said at least one stiffening band is connected to said continuous wall at said upper end thereof to provide reinforcement thereto.

* * * * *